US005097256A

United States Patent [19]

Eldridge et al.

[11] Patent Number: 5,097,256

[45] Date of Patent: Mar. 17, 1992

[54] METHOD OF GENERATING A CURSOR

[75] Inventors: George L. Eldridge, Long Beach; Munir G. Salfity, Hawthorne, both of Calif.

[73] Assignee: Xerox Corporation, Stamford, Conn.

[21] Appl. No.: 590,395

[22] Filed: Sep. 28, 1990

[51] Int. Cl.[5] ..... G09G 3/22

[52] U.S. Cl. ..... 340/799; 340/709

[58] Field of Search ..... 340/710, 709, 799

[56] References Cited

U.S. PATENT DOCUMENTS

| | | | |
|---|---|---|---|
| 4,646,078 | 2/1987 | Knierim et al. | 340/750 |
| 4,668,947 | 5/1987 | Clarke | 340/709 |
| 4,706,074 | 11/1987 | Muhich et al. | 340/709 |
| 4,918,427 | 4/1990 | Clarke | 340/758 |

OTHER PUBLICATIONS

Mitsubishi Electric Specification of the M5M4C264P-12 Dual-Port Dynamic RAM, Aug. 1986.

*Primary Examiner*—Alvin E. Oberley
*Assistant Examiner*—Matthew Luu
*Attorney, Agent, or Firm*—Robert E. Cunha

[57] ABSTRACT

A system for using the page buffer memory which stores the pixel map to generate the cursor in a CRT display. An unused portion of the memory is used to store a duplicate copy of the band in which the cursor is currently located, and the cursor is written into its appropriate location in this duplicate band, thus destroying the underlying image in the duplicate, but not in the original. The display is then generated by cycling through the page buffer except that the duplicate band containing the cursor, instead of the original band containing the underlying image, is displayed. After each display is generated, during the time when the scan returns from the bottom to the top of the display, if the cursor has moved since the previous display, the new band containing the cursor is created in the unused portion, and the display process is repeated.

2 Claims, 18 Drawing Sheets

METHOD OF GENERATING A CURSOR

BACKGROUND OF THE INVENTION

This invention is a circuit for the high speed generation of a cursor in a high resolution gray scale display, and more specifically comprises a set of video RAM's having a capacity larger than that needed for the storage of the display, the added capacity being used to store a duplicate band of video containing the cursor. The high speed internal video transfer capability of the RAM being used to create this band as needed.

Modern reprographic systems require sophisticated displays. In particular, such a system may have a high-resolution gray scale display. However, in such a system the generation and accurate tracking by the display cursor generated by a mouse or other cursor generating device requires additional circuitry or processing overhead.

In a typical system, a memory would be used to store the image of the display, and the cursor would be masked into the memory at the appropriate position. Then, as the cursor generating device such as a mouse is moved, the cursor would have to be deleted from its original position, and re-generated in its new position. Since the color of the cursor is uniform and fixed, such as black, the creation of the new cursor is relatively simple. However, at the same time, the position of the previous cursor must be returned to its original gray scale color, and that requires that the original image gray levels must be stored in another memory of some kind. When the cursor is moved to a new position, the new cursor must be generated and the gray levels of the previous position must be determined from the memory and masked into the display. Since there are a plurality of bits per pixel, these masking and storing steps may proceed at an undesireably slow speed. What is required is a system which can accomplish these steps at high speed and preferably without the requirement of added circuitry.

SUMMARY OF THE INVENTION

In this system a set of Video RAM's is used which has sufficient storage to store the entire display of video and an additional copy of the band of video in which the cursor will occur, and the cursor is masked into the additional band. Now, as long as the cursor is stationary, the system will refresh the display by cycling down through the video stored in the main part of the storage area until it reaches the cursor band. At that point the display will be refreshed with the extra band containing the cursor. Now, if the cursor is moved in any direction, the original additional band is simply overlaid with the new band which is copied from the main display storage.

This system is superior to the prior art system since the prior art masking steps require the processor to read from and write to storage at memory cycle rates, while in this invention, data transfer between two areas of the video RAM is completely internal to the memory chips and can take place at a much higher rate. Therefore by relying on internal transfers of video within the video RAM, the speed of the system is significantly enhanced. Also, no additional circuitry is required.

DETAILED DESCRIPTION OF THE INVENTION

Figure 1A:
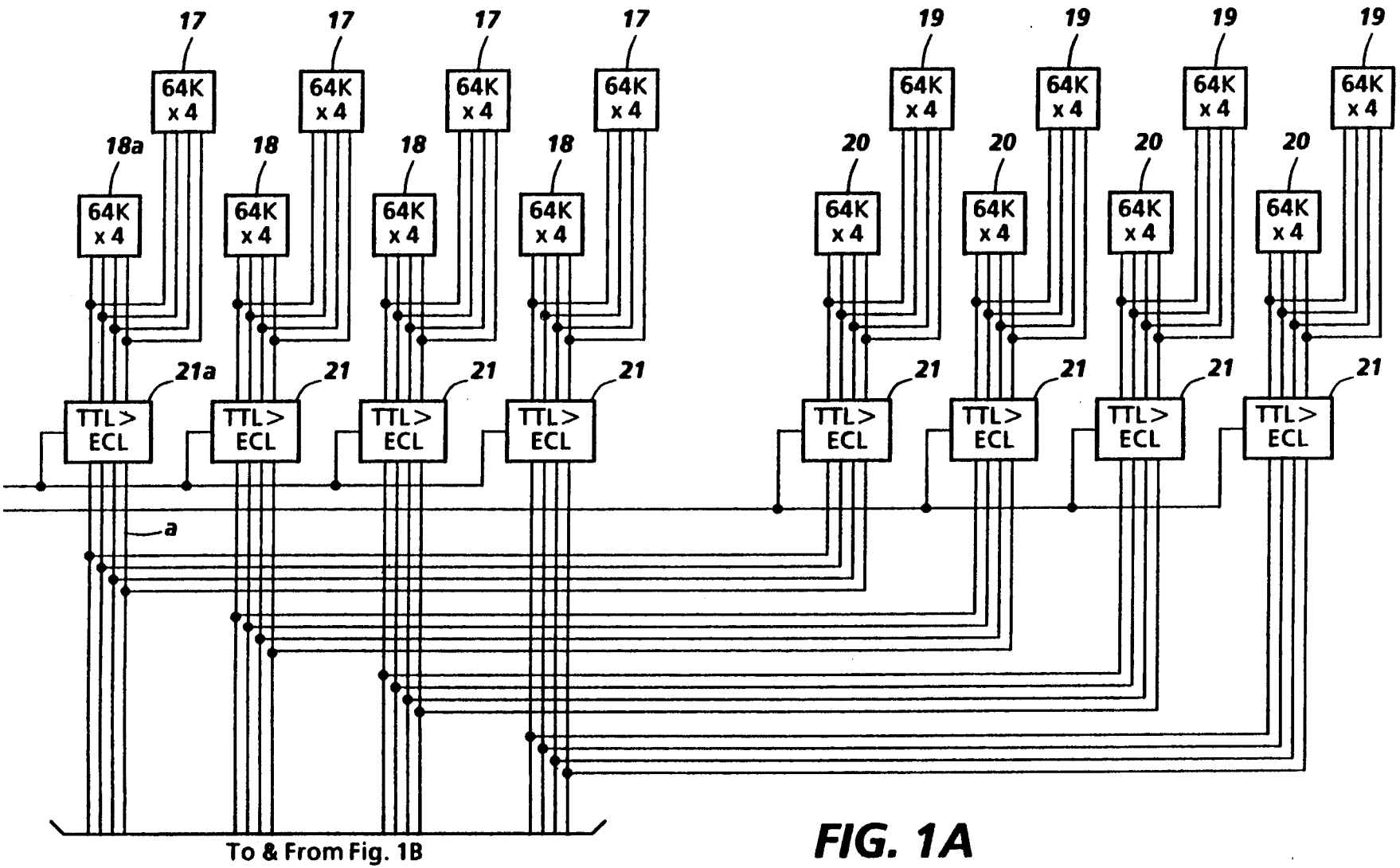
FIGS. 1A and B are block diagrams of the memory organization.
Figure 1B:
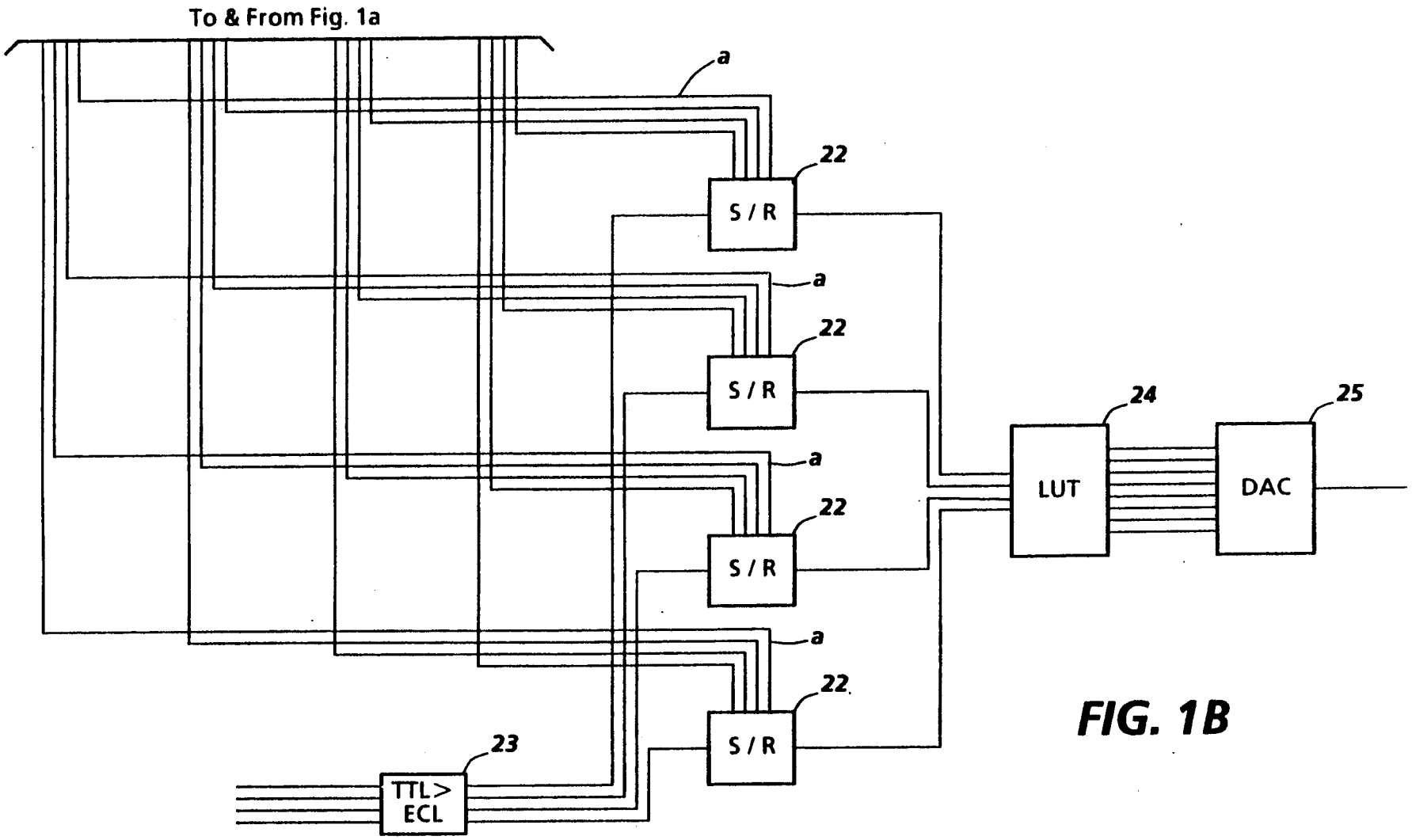

The video RAM circuit of FIG. 1 contains a 4-bit/-pixel bit-mapped image that is used to refresh the video image on the user interface (UI) display monitor. The frame buffer of the UI is a 4-Megabit array of dual-ported video RAM. The array is made up of 16 dual-ported dynamic RAM devices. The video RAM is a 256 K bit dynamic RAM organized as 64 K×4. The video RAM also has four 256-bit internal serial shift registers, not shown, that operate asynchronously with the processor interface.

The display is a monochrome monitor with up to 832 lines of 1088 pixels each. There are provisions for a 32 line border at the top and bottom of the screen and 32 pixel borders on the left and right sides. The resulting addressable display area is 768 lines of 1024 pixels. The display is not interlaced.

Each pixel in the addressable display area is represented by 4 bits in the frame buffer. The four bits are used with a lookup table 24 to provide an 8-bit value for a D/A converter 25. This makes it possible to display a picture using 16 of 256 shades of gray. The lookup table 25 makes it easy to vary the contrast of the displayed image.

The frame buffer is 4 Mbits arranged as 16-bit words. Each 16-bit word describes four 4-bit pixels. The first word contains the four pixels displayed at the upper left of the addressable area, the first pixel displayed is the one in the most significant four bits of the word. The first 256 words of the frame buffer correspond to the first line in the addressable area of the display. The next 256 words of the frame buffer are the second line of the addressable area of the display. This continues to the 768th line of the addressable display. The addressable display area requires 3 Mbits. The remaining 1 Mbit of the video RAM is used for cursor operations.

The frame buffer is divided into two banks. Each bank has eight 64 K×4 devices. The internal serial registers in each bank of 8 devices contain 8×256×4 bits of data; that is, enough for two lines on the display. The banks are arranged so that they contain alternating pairs of display lines (i.e., lines 1, 2, 5, 6, 9, 10 . . . , 764, 765 are in bank Al lines 3, 4, 7, 8, 11, 12, . . . 767. 768 are in Bank B). The four serial outputs from each device provide the 4 bits required for each pixel.

Address bits are used to decode four areas in the memory space. The dual port RAM occupies the first area (00000h–04000h). The video RAM occupies the remaining three areas. Each area provides a different way of accessing the video RAM. The second area (4000h–7FFFFh) provides normal access to the video RAM. The video RAM appears as an array of 16-bit words that can be read and written.

The high speed video logic serializes the 4-bit/pixel video RAM 2 data and converts it into an 8-bit/pixel intensity code with a look-up table 24. The intensity code is then fed to a video digital-to-analog converter (DAC) 25. The video DAC produces an amplitude modulated analog signal used to drive the UI display monitor.

The serial register outputs of the RAM devices in the left and right banks are connected together. Multiplexing is accomplished by enabling the serial outputs of only one bank at a time. The left bank is enabled for two scan lines, then it is disabled and the right bank is enabled for two lines.

The eight pixels (32 bits) from the RAM serial outputs are fed into TTL-to-ECL translators 21. The translators are grouped so that the words with even addresses go to one set of translators and the words with odd addresses go to another set of translators. The outputs of the even-word translators are "wire ORed" to give four pixels (16 bits). The enable inputs on the translators are controlled so that either the even word or the odd word appears at the translator outputs.

Four pixels of data (16 bits) are moved from the serial ports of one bank into a four-pixel shift register 22 every four pixel clocks. By multiplexing the even words and odd words in the bank, each serial port is cycled once every eight clocks.

The four bit/pixel data loaded into th ECL shift registers 22 is shifted one bit every pixel clock. The data from the ECL shift registers 22 go to an ECL lookup table 24. The four bit per pixel data is converted to 8-bit per pixel data with the lookup table. The resulting 8-bit value is fed to a video DAC where it is converted into an amplitude modulated analog signal to drive the CRT.

The video RAM can transfer data from the RAM to the internal serial register and from the serial register into the RAM. This feature makes it possible to copy an entire column in the RAM (1024 locations) to the special band in RAM quickly. During the vertical blanking time, the lines that will contain the cursor are transferred from the active display area to the special buffer in the non-displayed area of memory.

The cursor is then written into the special internal buffer at the proper location. When the frame reaches the band that contains the cursor, instead of loading the shift registers 22 from the active display area of RAM, they are loaded from the special internal buffer. When the end of the special internal buffer is reached, the shift registers 22 are loaded from the active display area again.

Figure 18A:
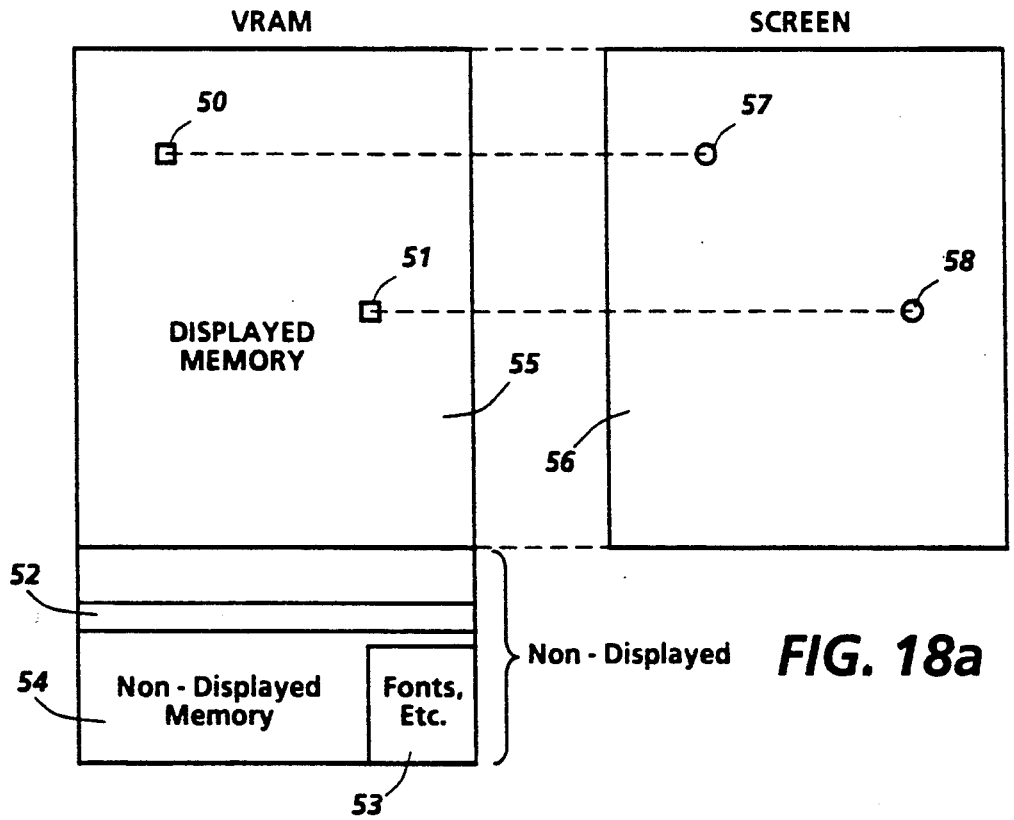
FIGS. 18*a* and 18*b* are diagrams of the display showing the band and cursor.
Figure 18B:
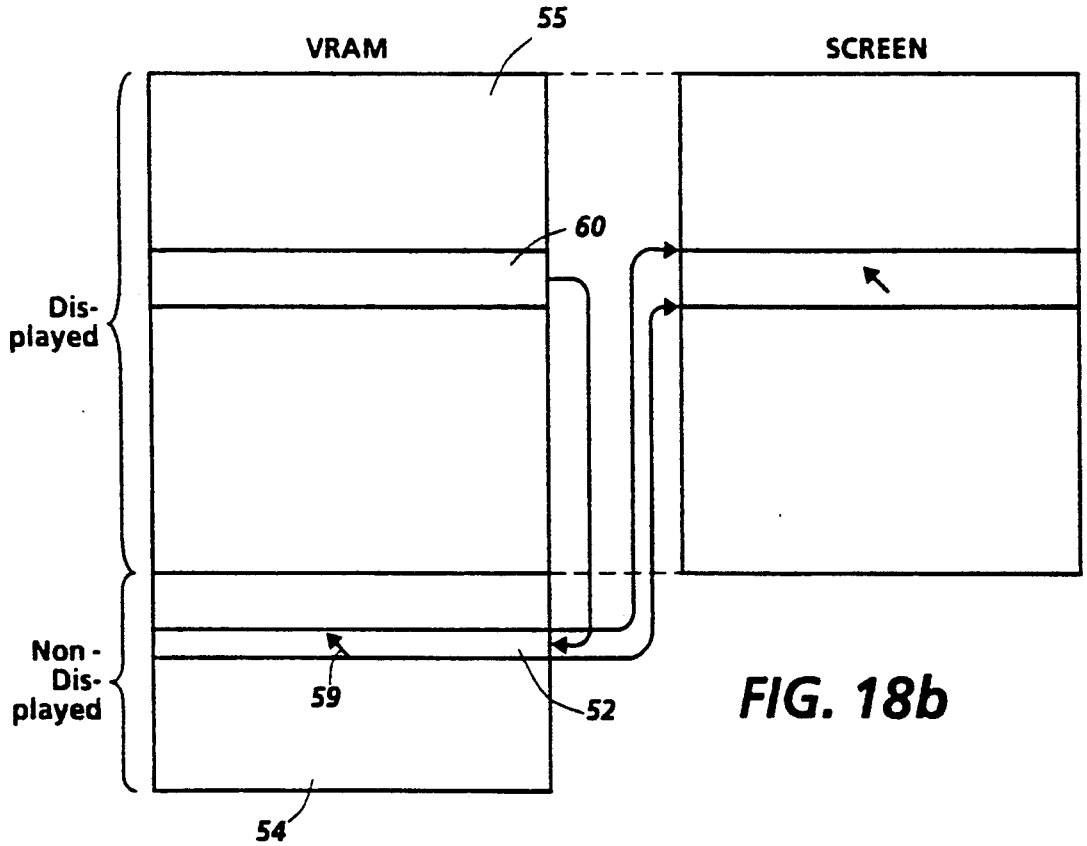

The relationships between these display features and the memory are shown in the diagrams of FIGS. 18*a* and 18*b*. FIG. 18*a* shows an area 55 of the VRAM which stores the pixel map comprising pixels 50, 51 of the display which is used to generate the display 56 comprising the associated dots 57, 58 on the screen. There is extra capacity built into the VRAM, shown as the non-displayed area 54 which has a font area 53 and a cursor band area 52. As shown in FIG. 18*b*, the band containing the cursor is copied by internal block transfer from the main storage area into the non-displayed area 54 to form a band 52, and it is into this band that the cursor is copied. Then, as the display is shifted out of the memory 55 from top to bottom, when the band 60 is encountered, the data containing the cursor image will be shifted out from the cursor band 52. Finally, the remainder of the image will be shifted out from the displayed memory 55, resulting in the screen containing the cursor, as shown.

The specific schematic diagrams in FIGS. 3 through 17 will be discussed in conjunction with the block diagrams of FIGS. 1 and 2.

Figure 2:
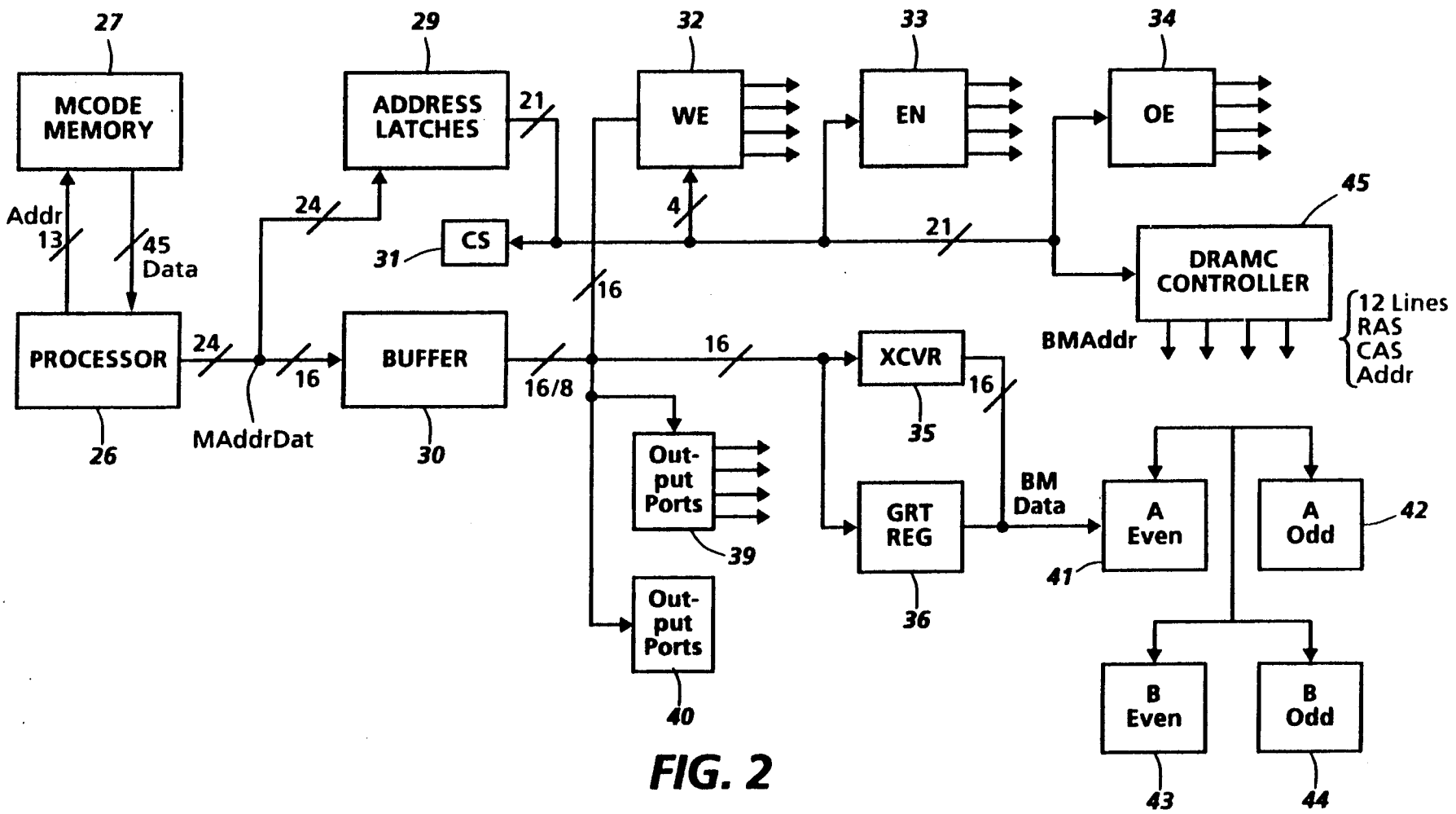
FIG. 2 is an overall block diagram of the mask circuits.
Figure 3A:
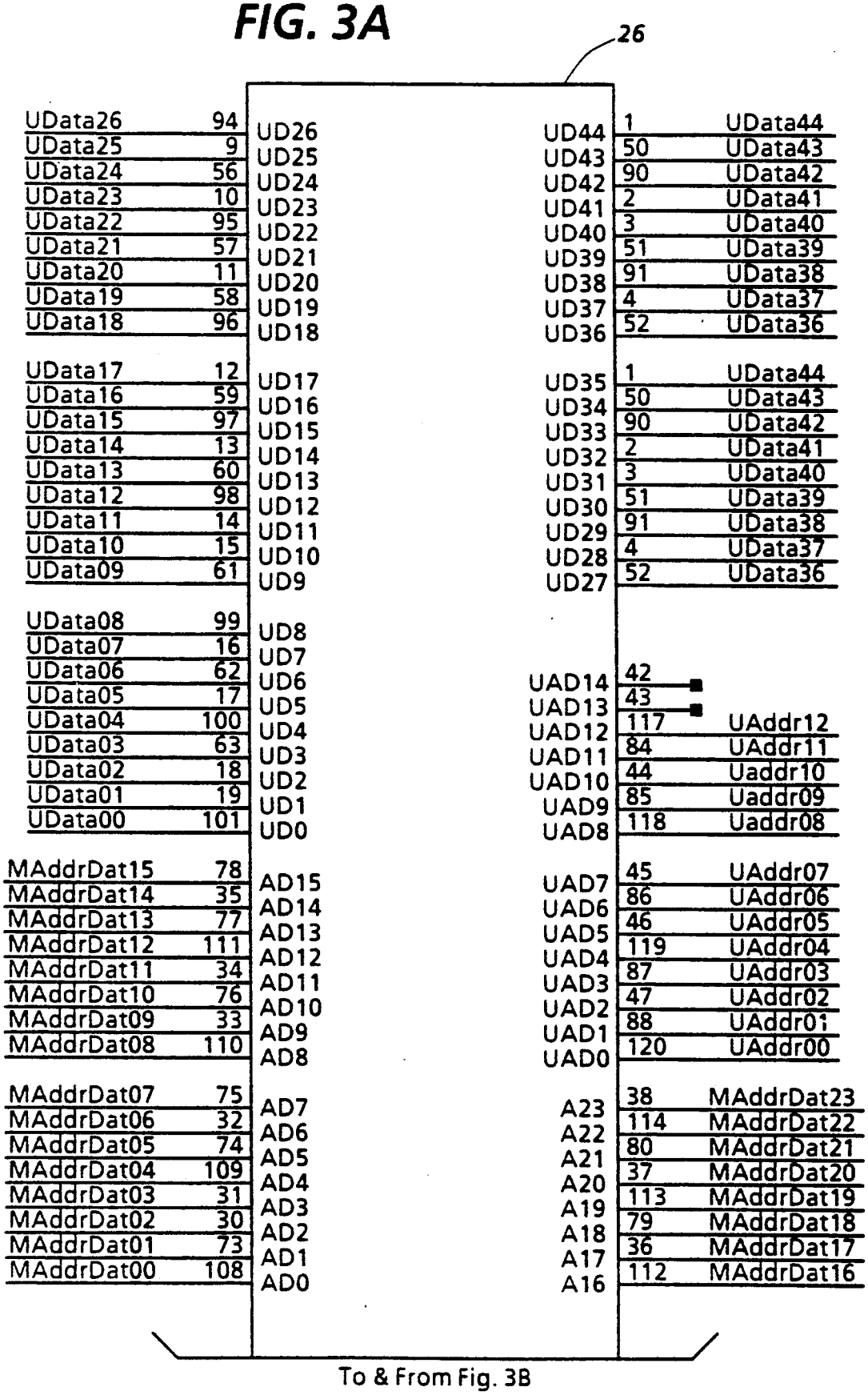
FIGS. 3A and B are schematic diagrams of the processor.
Figure 3B:
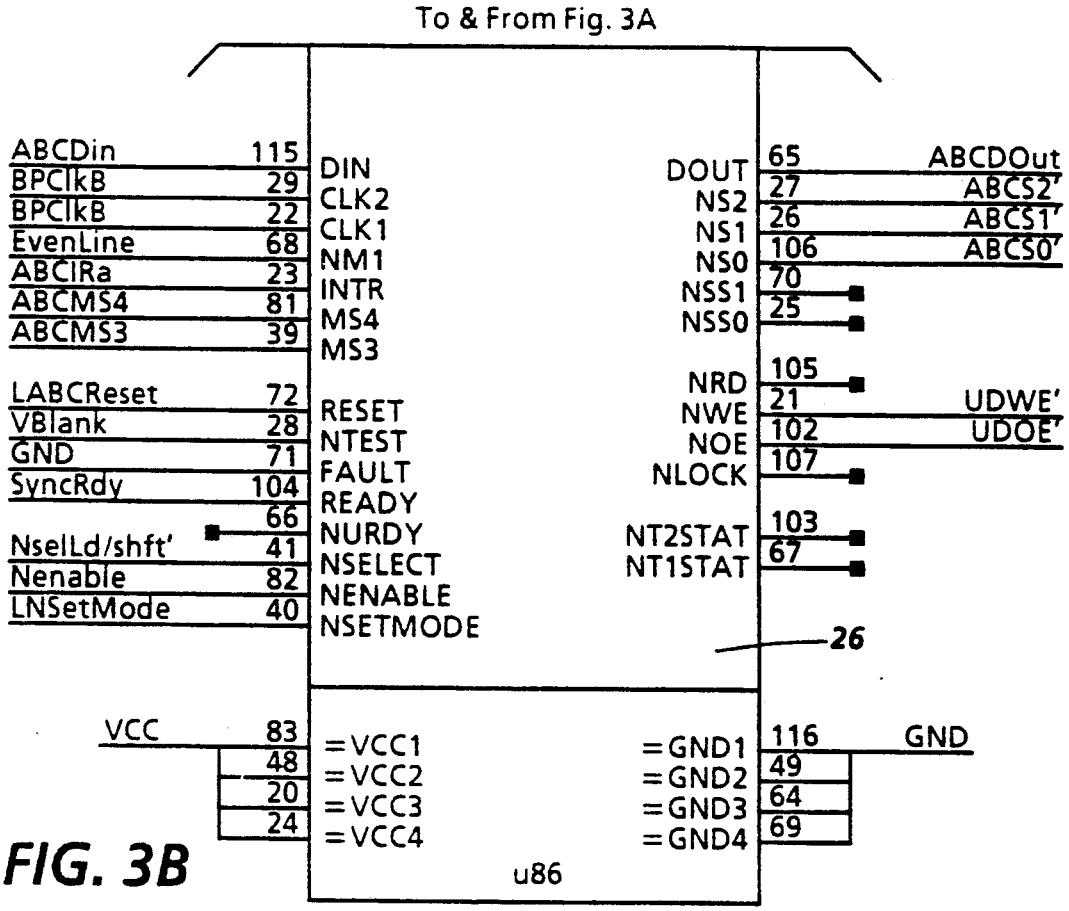
Figure 4:
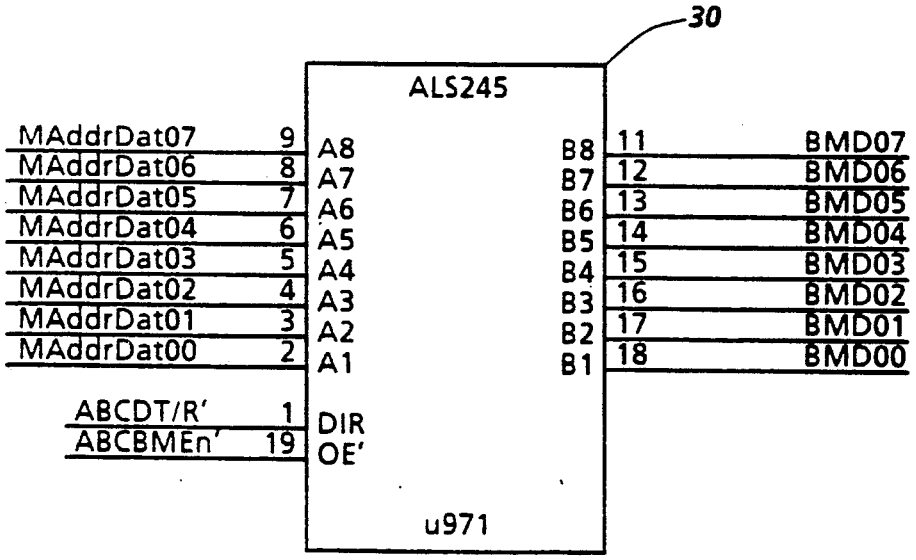
FIG. 4 is a schematic diagram of one of two buffer devices.
Figure 5:
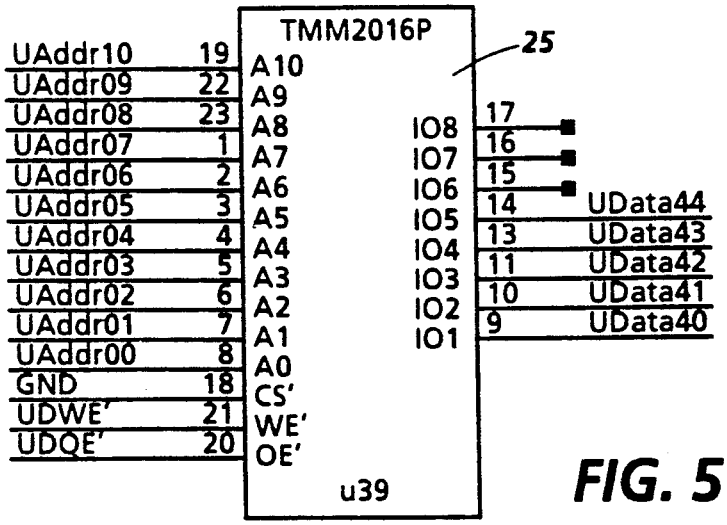
FIG. 5 is a schematic diagram of one of six microcode memory devices.
Figure 6:
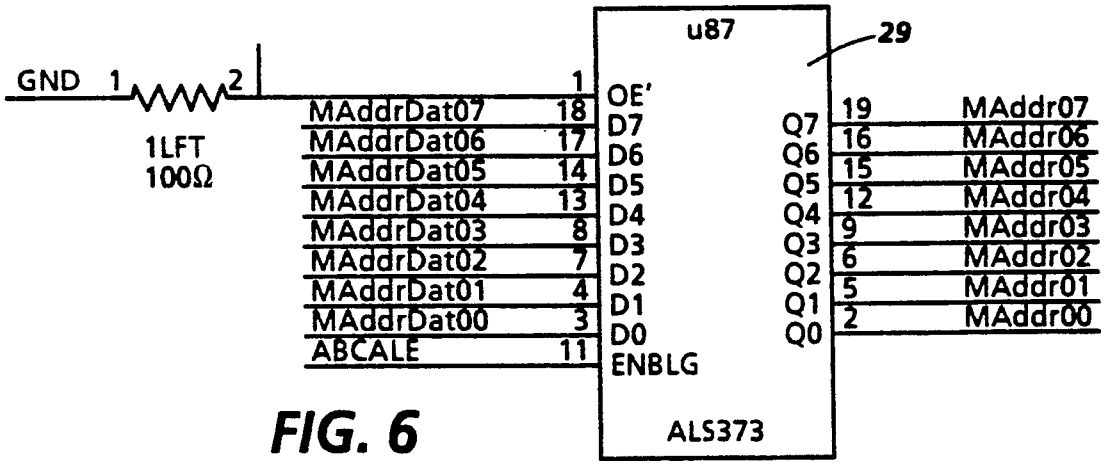
FIG. 6 is a schematic diagram of one of three latch devices.
Figure 7:
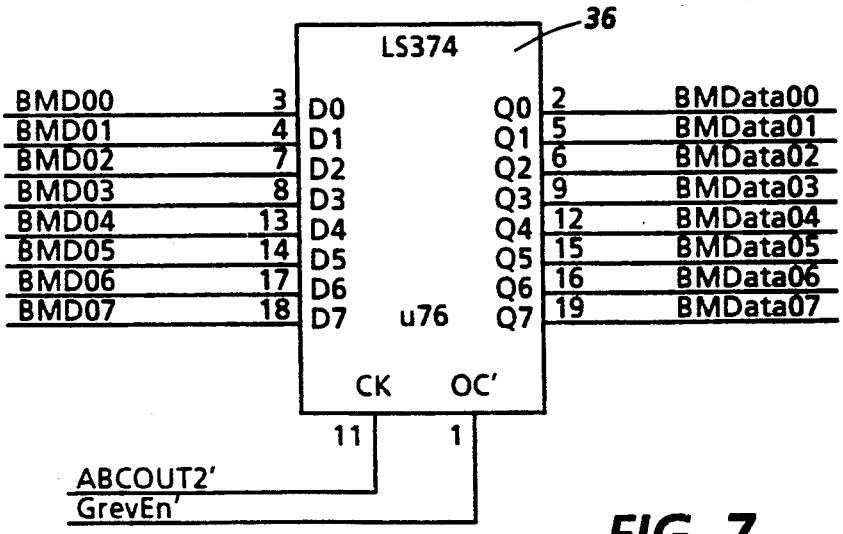
FIG. 7 is a schematic diagram of one of two gray registers.

In FIG. 3, the processor 26 controls the mask process, and is shown in FIG. 2 as the processor 26. It is a microcoded controller which works with an accompanying writable microcode store 27 of FIG. 2 which is loaded at power-up time. The 13 pins of the processor 26 labelled UAddr are addresses to the microcode, or memory store, and the 45 pins labelled UData are the data words from the microcode store comprising instructions for the processor to command the current step of the process. The remaining large set of processor pins are the 24 multiplexed output address lines labelled MAddrDat. The low order 16 bits are multiplexed address and data words, the remainder are address bits. The 16 data bits are first buffered in two buffers, one of which is shown as register 30 of FIG. 4 to produce bits on the 16 BMD lines.

The microcode memory comprises six identical static RAM devices which together receive 11 bits addresses and produce 45 bit data words. One of the devices 27 is shown as FIG. 5.

As shown in FIG. 2, the 24 MAddrDat lines are sent first to the address latches 29. These are three latch devices which demultiplex the MAddrDat lines to produce 21 Maddr bits. One of these three identical devices is shown as latch 29 of FIG. 6.

Figure 8:
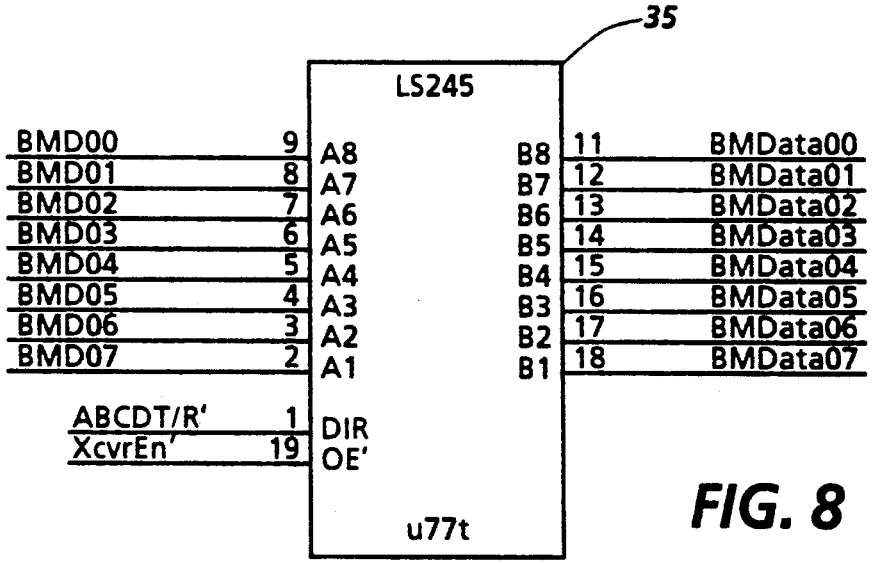
FIG. 8 is a schematic diagram of one of two transceivers.

As shown in FIGS. 2 and 8, there is a transceiver 35 between the buffer 30 and the memory 41–44. This transceiver is implemented from two identical devices, one of which is shown, and allows data to flow in either direction. In parallel with this transceiver 35 is a gray register 36 of FIGS. 2 and 7 which is implemented from two latching devices, one of which is shown. This contains 4-bit per pixel gray levels which can be masked into the memory 41–44. These devices 35 and 36 are in parallel so both receive 16 bits of BMD data from the buffer 30 and produce 16 bits of BMData which connects to the memory 41–44. When either the gray register 36 or the transceiver 35 is enabled, the other is disabled.

Figure 9:
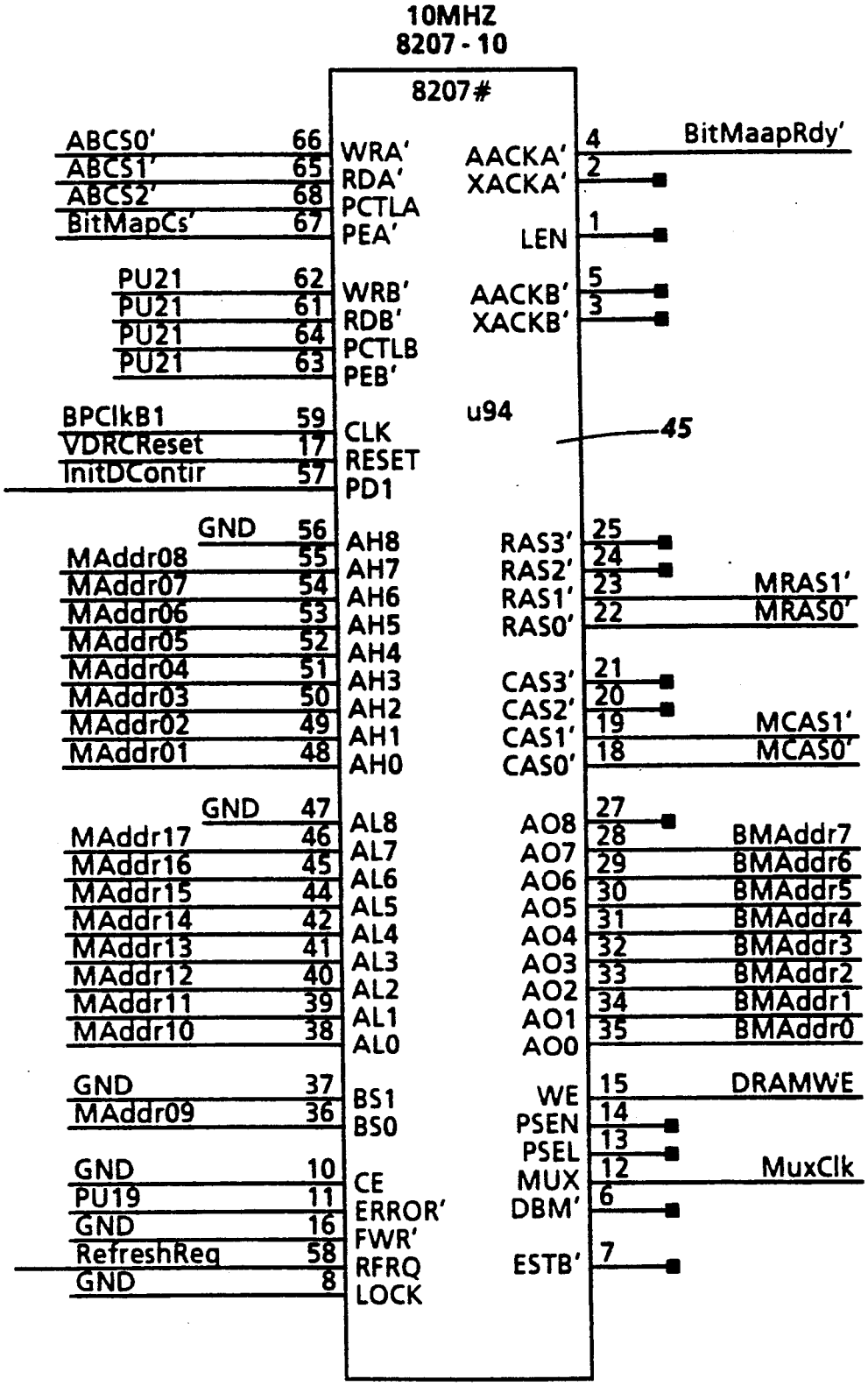
FIG. 9 is a schematic diagram of the DRAM controller.
Figure 11:
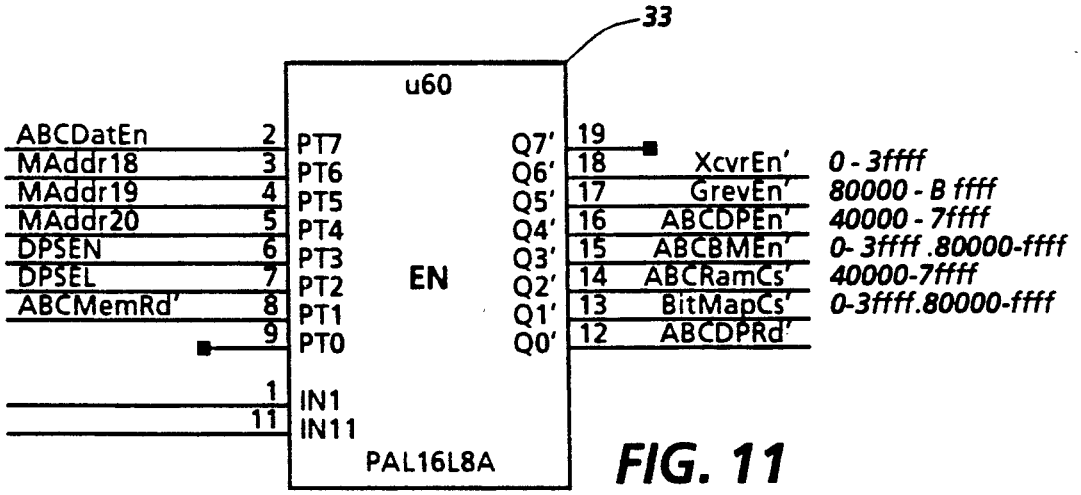
FIG. 11 is a schematic diagram of the memory chip enable device.
Figure 12:
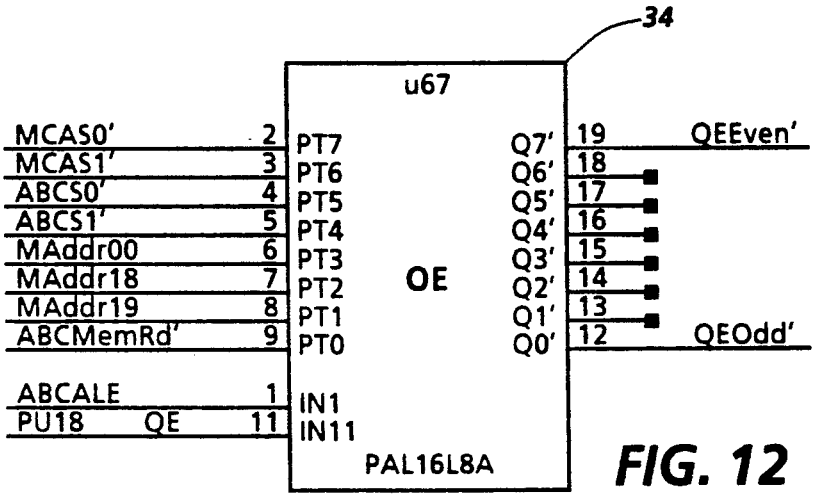
FIG. 12 is a schematic diagram of the output enable device which enables either the even or odd RAM devices.

FIG. 9 is a schematic of the dynamic memory controller 45 for the memory array. This memory is implemented from video RAM parts having dynamic memory and therefore needs to be periodically refreshed. The controller receives a 16 bit address from the address latch 29 and produces from that the necessary multiplexed address, RAS and CAS signals required by the memory.

Figure 10:
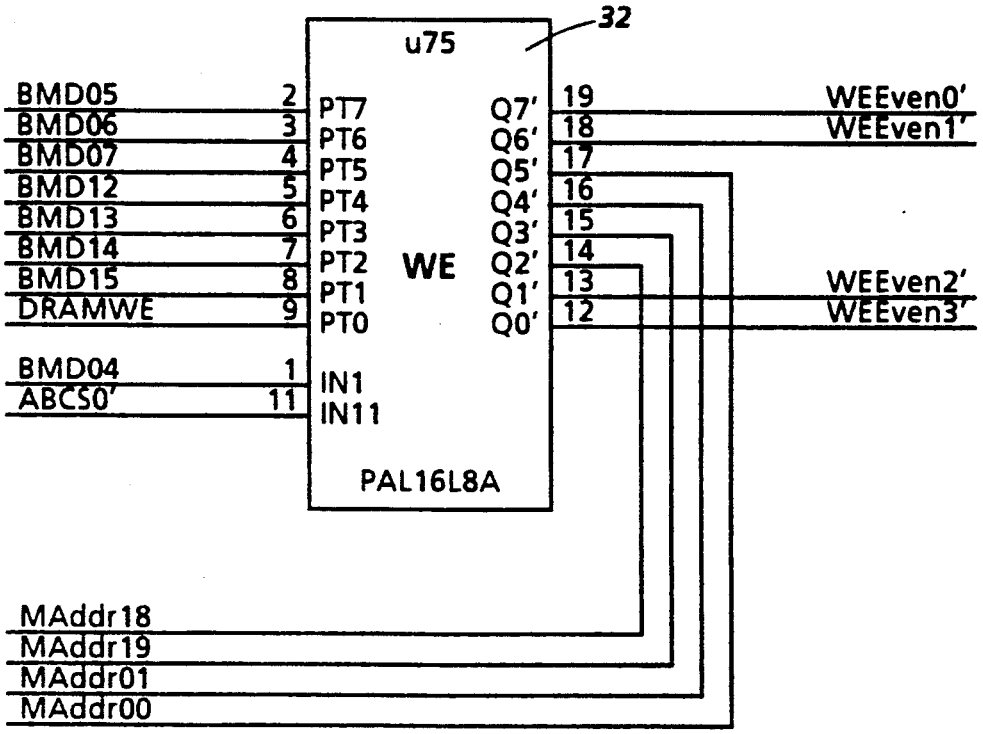
FIG. 10 is a schematic diagram of one of two write enable devices.

FIG. 10 is a schematic of the write enable circuit 32. The device receives 16 bits of BMD data and 4 bits of MAddr data and produces the write enable signals for the even numbered memory locations. An identical device, not shown, produces the signals for the odd numbered locations. The address enable device 33, a programmable logic array (PAL) device, of FIG. 11 receives the three most significant bits of address data and generates chip select signals. Finally, the output enable device, another PAL, 34 of FIG. 12 enables either the odd or even video RAM devices.

Figure 13:
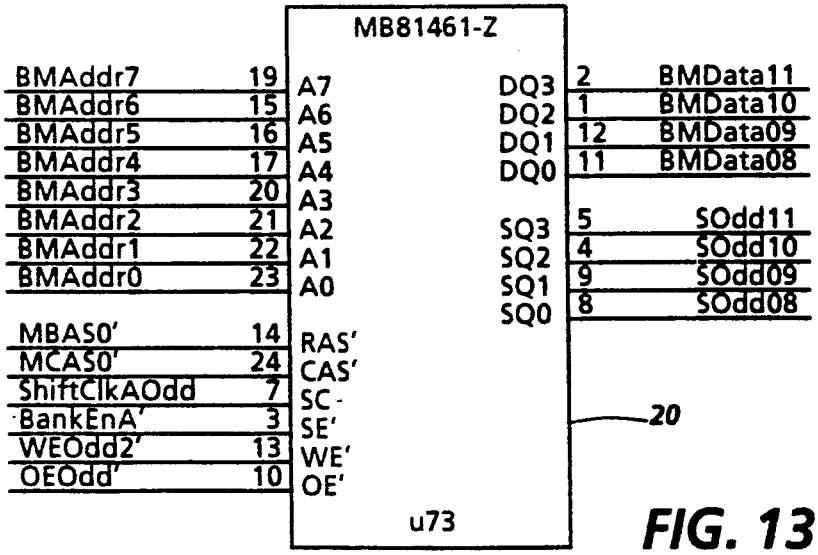
FIG. 13 is a schematic diagram of one of sixteen video RAM devices.

FIG. 13 is a schematic of one of eight identical video RAM devices 20 comprising Bank A. An additional set of eight forms Bank B. A video RAM is a RAM device with the added feature of a serial shift register built into the part. In operation, a row of data can be transferred internally from memory to the register, and then the data can be output from the register without further action required on the part of the memory. This allows the transfer of two lines of video into the shift register, from which the data can be shifted out at a rate required for display on the screen. In this system, there will be 4 bits per pixel output from the memory, all taken from the same device. As shown in FIG. 13, each device is addressed by 16 BMData lines and outputs 4 bits of data labelled SOdd or SEven. The combined capacity of the registers of all devices is sufficient to produce four lines on the display at 4 bits per pixel, two from Bank A, odd and even words, the next two from Bank B, odd and even words. In fact, the device shift register output is not fast enough to supply data to the display, so alternate odd and even words from bank A are multiplexed out to produce two lines, and then alternate odd and even words from Bank B are shifted out to form the next two lines. This is shown in FIG. 2 as four blocks, A Even 41, A Odd 42, B Even 43 and B Odd 44.

This arrangement is shown in simplified from in FIG. 1. Bank A comprises a total of eight devices 17, 18 and Bank B comprises eight devices 19 and 20. In Bank A the odd words are stored in devices 17 and the even in devices 18. Similarly, in Bank B the odd words are in devices 19 and the even words are in devices 20. For the first two lines, Bank A multiplexers 21 output odd and even words from memory to the shift registers 22, for the second two lines, odd and even words from Bank B are output. This arrangement is advantageous in that time is required for the video RAMs to load the internal register from the RAM locations. With two Banks, one Bank can be shifting out data while the other Bank is loading its internal register.

The 16 bit output of each bank at any moment is stored into shift registers 22 in parallel, and then each shift register shifts out in 4 clock cycles its contents to a look-up table 24, the bits arriving 4 bits in parallel. These 4 bits can then be used to pick out any 16 of 256 gray levels, the associated 8 bit word being applied to a DAC 25 to drive the intensity of the CRT. The circuit is arranged so that the 4 parallel bits out from any memory device will arrive in parallel at the look-up table. For example, the 4 bits in parallel from memory device 18*a* will all be shifted through line a into the rightmost bit of the shift registers 22 and therefore will be applied at the same time to LUT 24.

Figure 14:
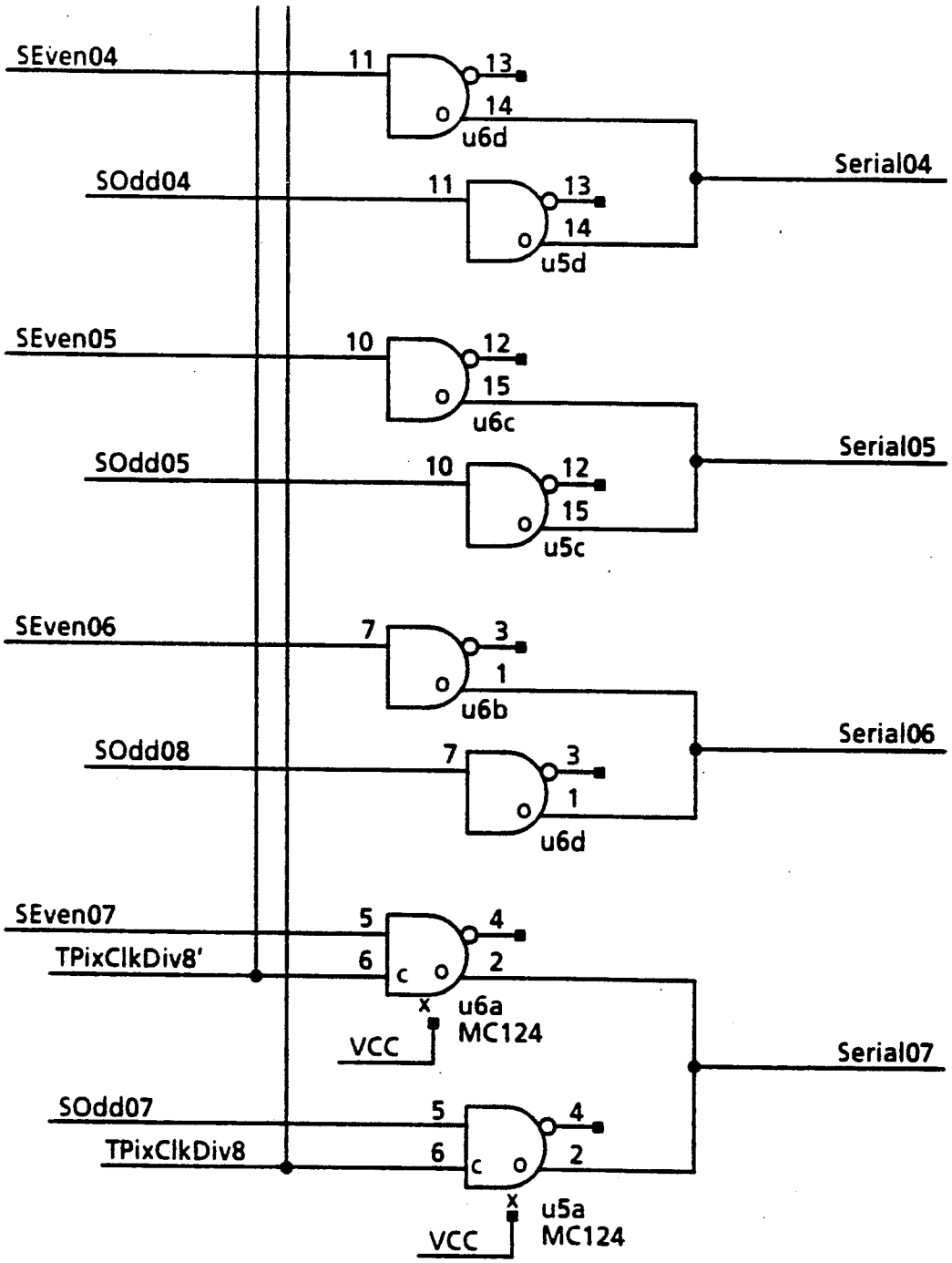
FIG. 14 is a schematic diagram of eight of thirty-two multiplexing gates.

The multiplexers 21 of FIG. 1, which switch between odd and even words, are shown in more detail in FIG. 14 which shows eight out the total of 32 gates required to implement the entire set of multiplexers.

The multiplexers 21 work in conjunction with the shift registers 22 to serialize the data. That is, the memory outputs 16 bits per clock cycle, but the LUT 24 requires them 4 bits at a time. This conversion is done by the shift registers 22 which receive the 16 bits in parallel, and then output them 4 bits at a time. These registers are shown in schematic form in FIG. 15 which shows one of the four identical registers receiving the 4 bits of data in parallel and outputting 1 gray bit at a time. One refinement here is to provide a border data bit to each shift register so that the border of the page can also be specified as a gray level. This is also shown as gates 23 in FIG. 1.

Figure 15:
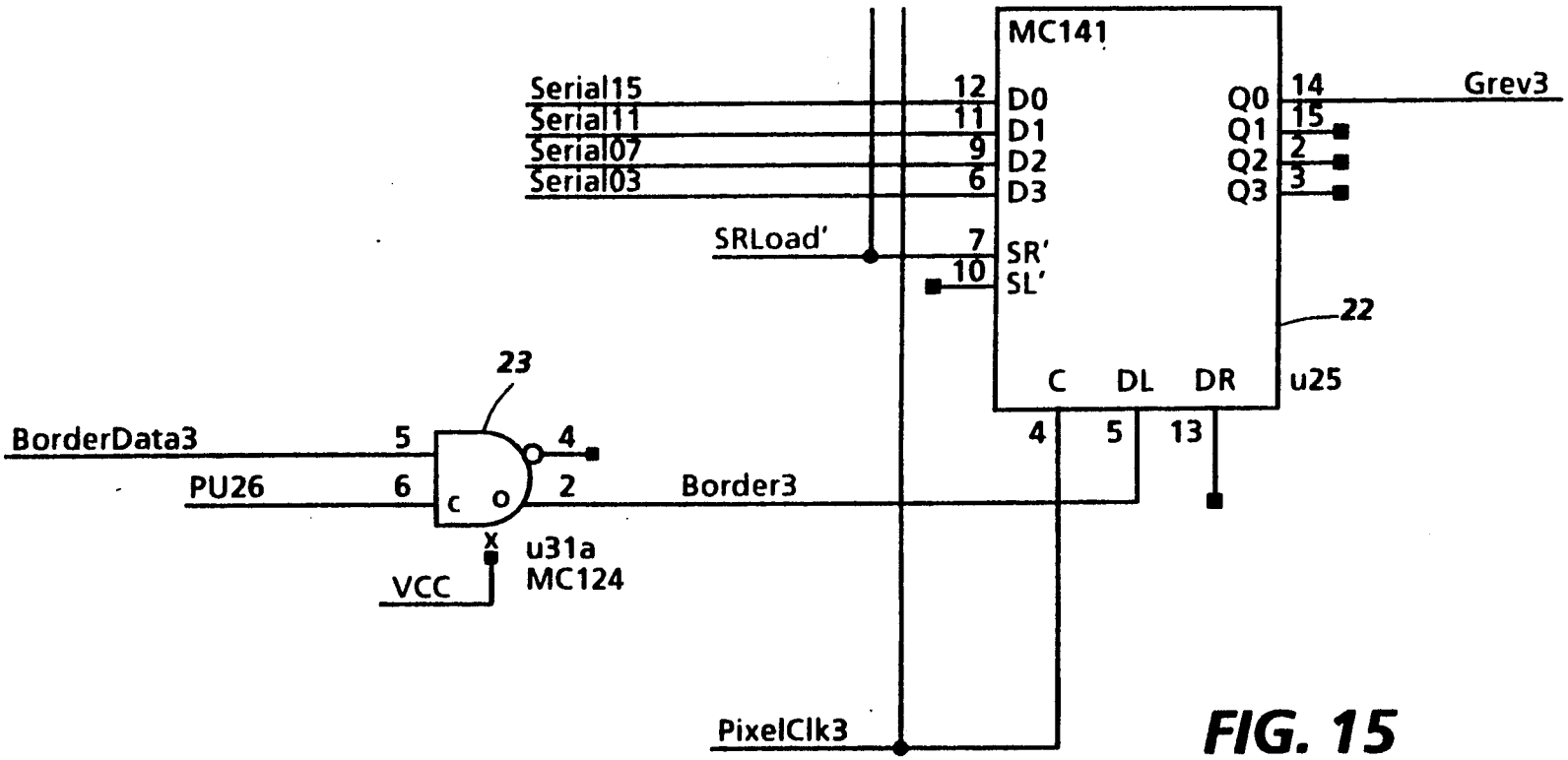
FIG. 15 is a schematic diagram of one of four shift registers of FIG. 1.
Figure 16:
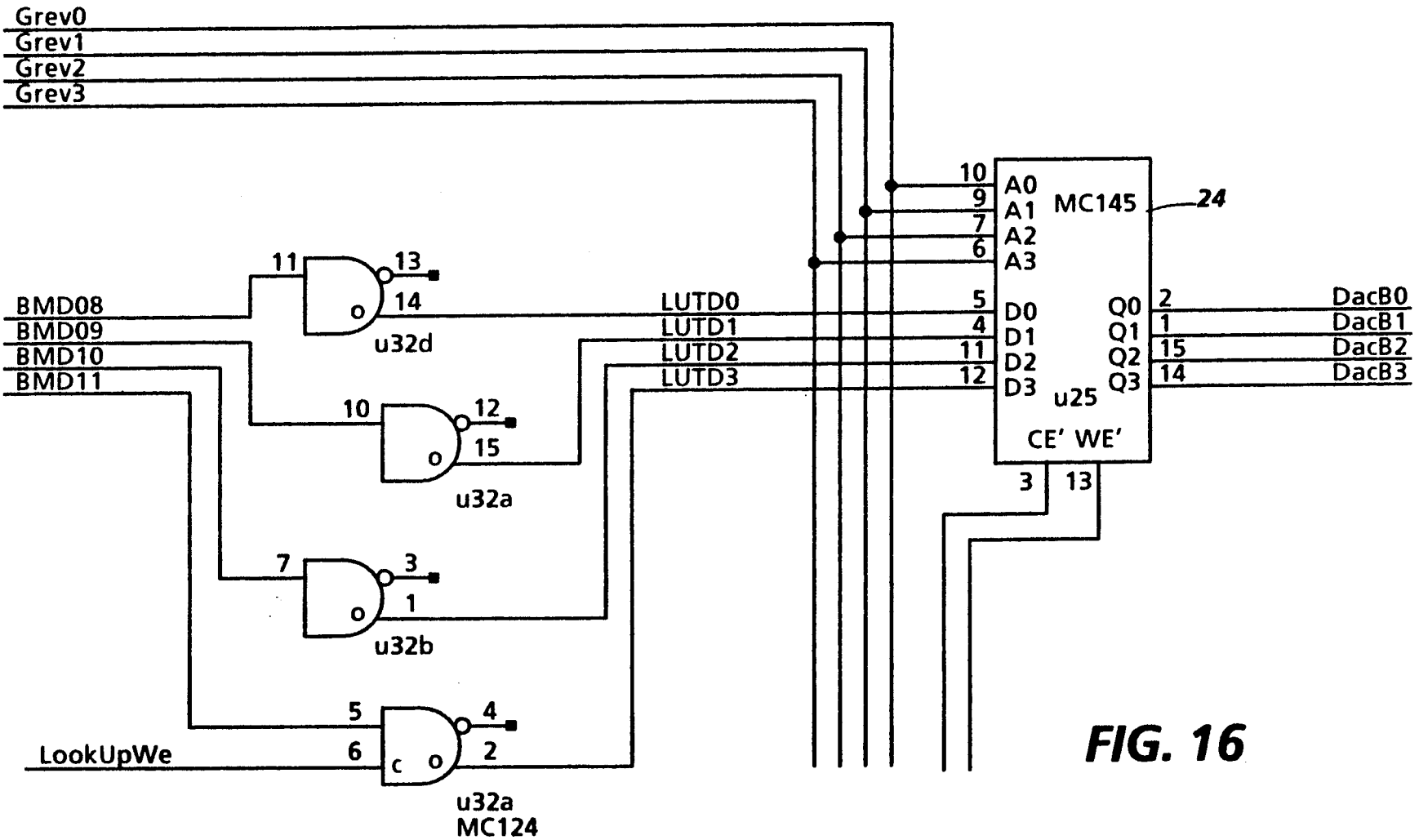
FIG. 16 is a schematic diagram of one of two table look-up devices.

The 4 bit output of FIG. 15 is sent to the look-up table 24 of FIG. 1, one half of which is shown in FIG. 16. The entire look-up table can be loaded with data so that the required eight bit output will result from any 4 bit input.

Figure 17:
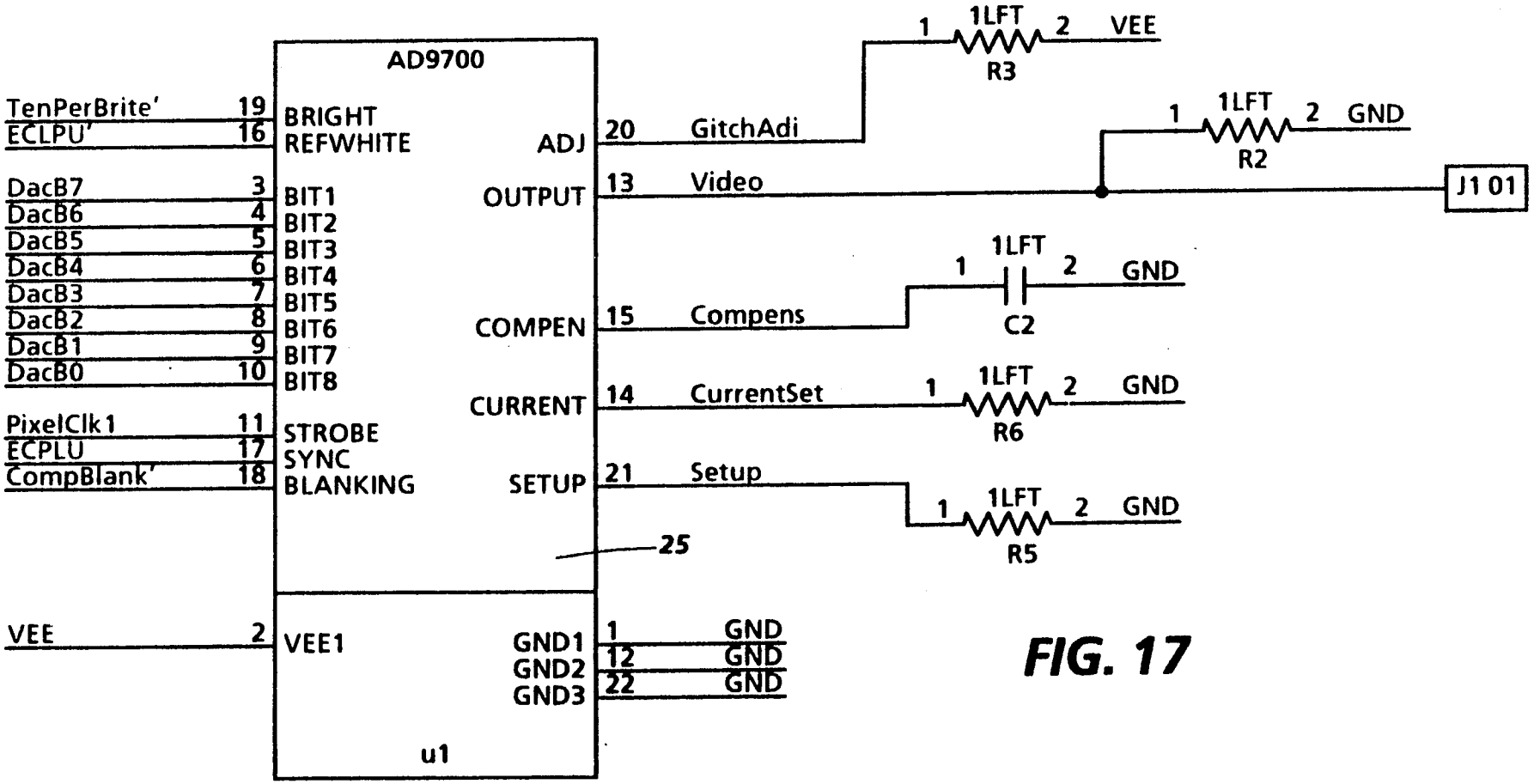
FIG. 17 is a schematic diagram of the DAC.

FIG. 17 is the digital to analog converter which accepts the eight bit output of the look up table and generates the actual analog video output signal.

Figure 19A:
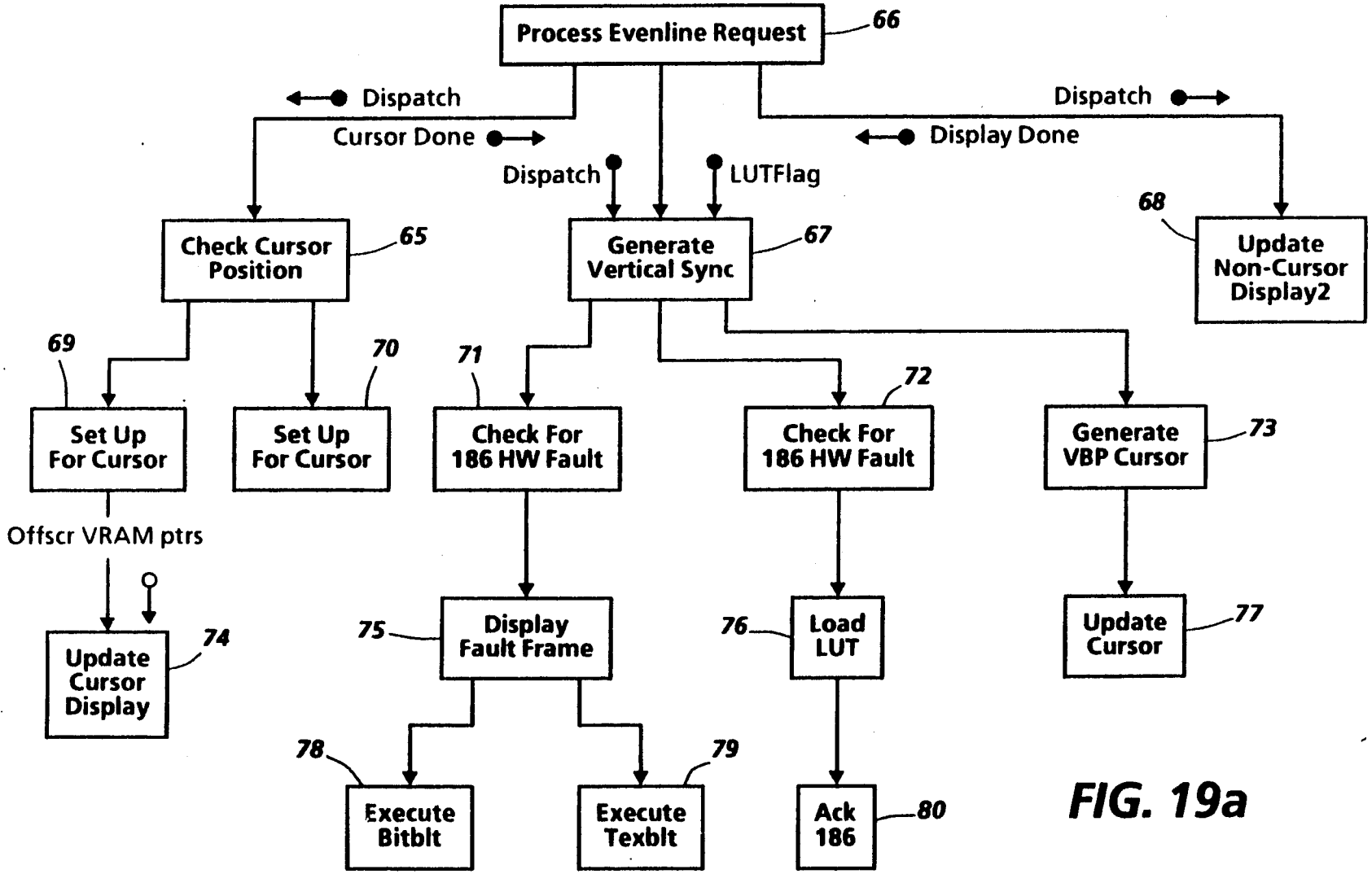
FIGS. 19*a* through 19*d* are flow charts of the cursor process.

FIGS. 19*a* through 19*d* are flow charts of this cursor process. At the start of an even line, as shown in FIG. 19*a*, the process starts by checking the cursor position 65. If the cursor position has changed, the cursor parameters are changed in the offscreen portion of the VRAM and the additional band storing the cursor is updated 69, 74. In these flow charts the commands follow the long arrows, which are always downward, and the data flow is shown as short arrows. If the cursor is not on, the normal display is updated 70.

At the start of the vertical blanking interval, step 67 is entered, which branches to a diagnostic step 71, a load look-up table 76 or a generate cursor step 73. If step 71 is selected, diagnostics are run on the hardware and the display. If it is time to load the look-up table, that is done in step 76 and 80. Otherwise the cursor will be updated 73, 77, which will be explained in more detail below.

Figure 19B:
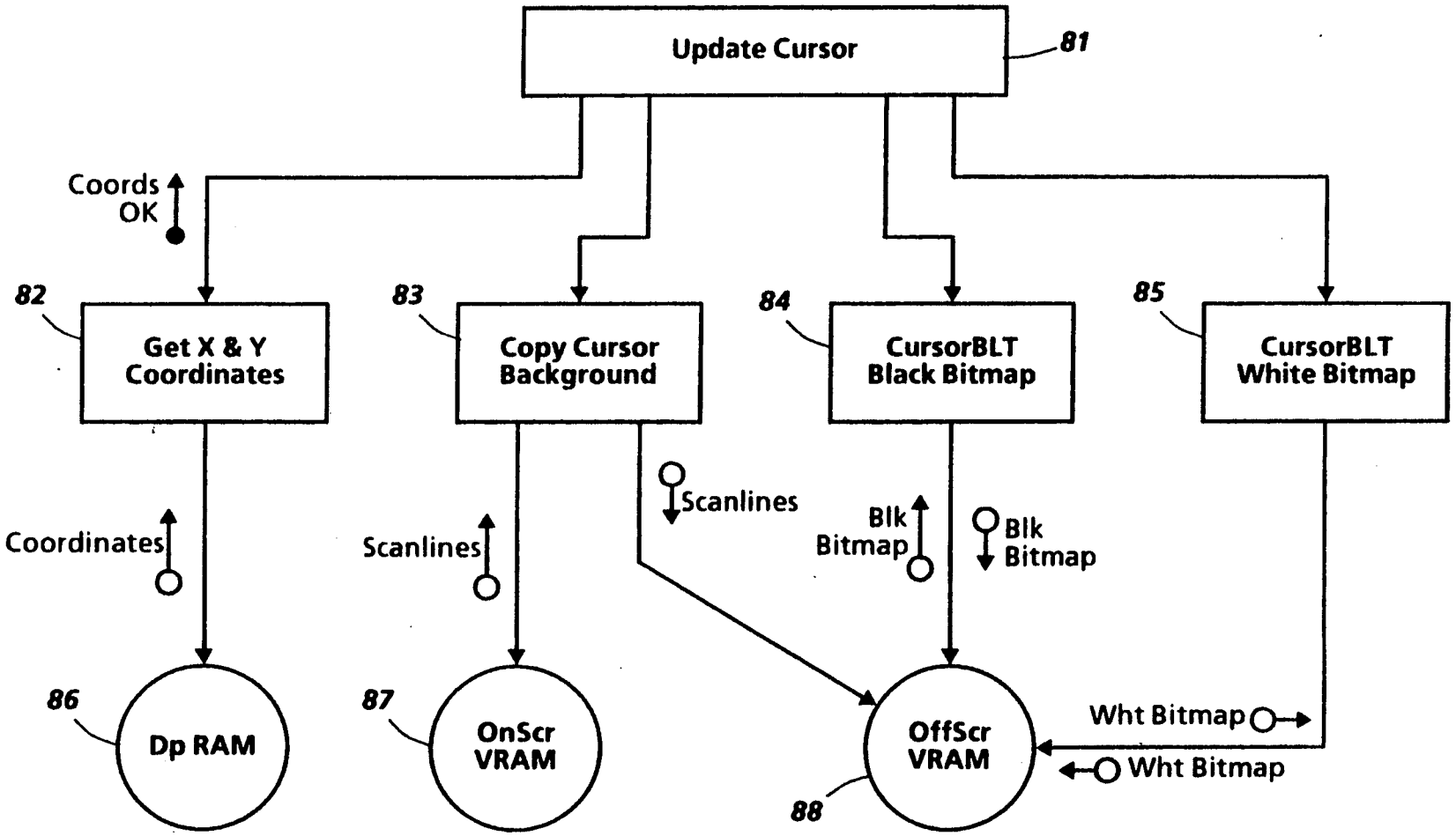
Figure 19C:
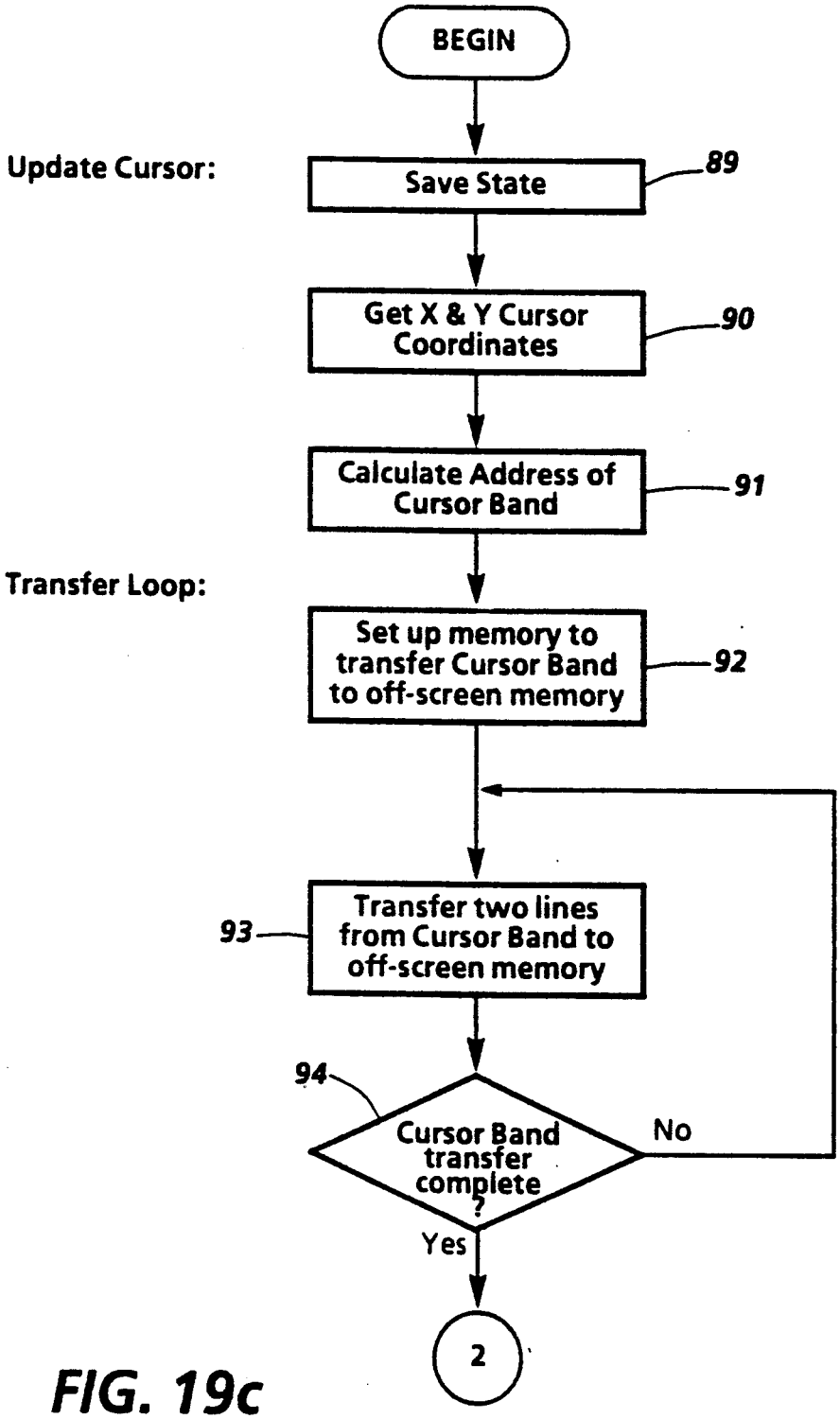
Figure 19D:
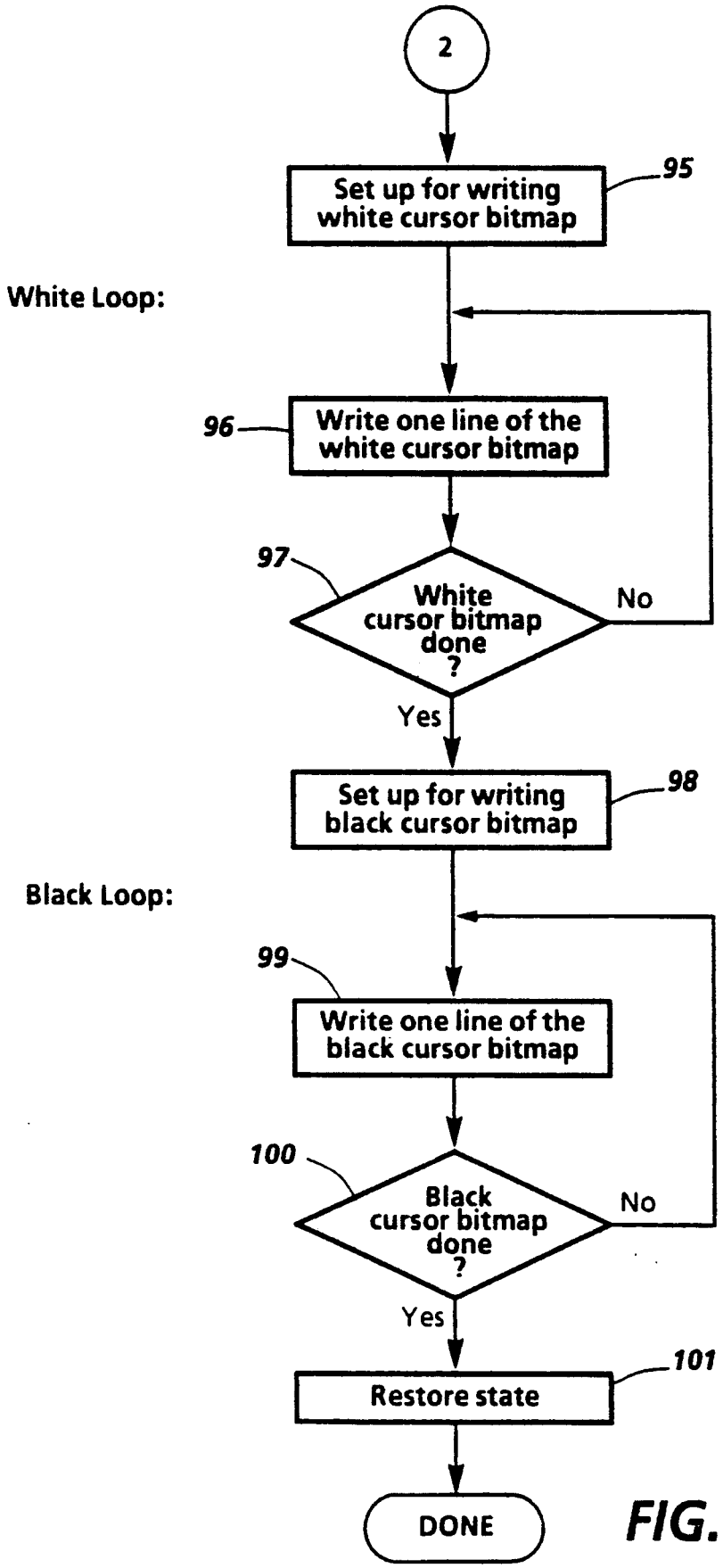

The cursor structure is updated as shown in FIG. 19*b*. The first step is to access the x and y coordinates 82 from the RAM 86. As shown, the call goes to the RAM 86 and the coordinates are passed back up to the program 81. Now having the coordinates, the program continues with copying the cursor background 83 from the onscreen RAM 87 to the offscreen RAM 88. The next two steps are to write the cursor into this offscreen RAM in either white 86 or black 84, thereby overlaying the display data under the cursor mask.

The process of FIG. 19*b* takes place during the blanking interval. This process is shown in more detail in FIGS. 19*c* and 19*d*. First the state of the display controller is saved 89. Next, the x and y coordinates are accessed 90 and the address of the cursor band is calculated 91. The VRAM devices are set up to transfer the band to the off-screen area of memory 92 and then the lines of the additional band are transferred two at a time in the loop 93, 94.

Next, the white cursor bit map loop transfers the white portion of the cursor one line at a time 95, 96, 97 and then the black portion is transferred 98, 99, 100. To the extent that the bit maps of the cursor must be offset one or several pixels, this is done during steps 96 and 99.

While the invention has been described with reference to a specific embodiment, it will be understood by those skilled in the art that various changes may be made and equivalents may be substituted for elements thereof without departing from the true spirit and scope of the invention. In addition, many modifications may be made without departing from the essential teachings of the invention.

We claim:

1. A circuit for generating a cursor for a display comprising:

means for identifying the location in memory of an original band of the pixel map in which the cursor is located, and the position of the cursor in the band, said memory for storing a pixel map of the image to be displayed and an additional band large enough to contain an image of the cursor, said memory comprising memory devices having an internal shift register of sufficient capacity to store the data contained in a plurality of memory locations, and means for transferring data between said memory locations and said register, said memory means responsive to said means for identifying for loading a copy of said original band in which the cursor is located into said additional band, means for loading a mask of said cursor into the position of the cursor in the additional band, and means for reading out said additional band instead of said original band for display.

2. The circuit of claim 1 wherein the transferring of data between said memory locations and said register is accomplished during the vertical blanking time.

* * * * *